United States Patent [19]

Takehana et al.

[11] Patent Number: 5,000,231

[45] Date of Patent: Mar. 19, 1991

[54] AUTOMATIC WEFT YARN PACKAGE CHANGING SYSTEM

[75] Inventors: Tatsuo Takehana, Matsutou; Yasuyuki Tamatani, Kanazawa; Masahiro Nagai, Kanazawa, all of Japan

[73] Assignee: Tsudakoma Kogyo Kabushiki Kaisha, Kanazawa, Japan

[21] Appl. No.: 418,176

[22] Filed: Oct. 6, 1989

[30] Foreign Application Priority Data

| | | | |
|---|---|---|---|
| Oct. 11, 1988 | [JP] | Japan | 63-255343 |
| Oct. 11, 1988 | [JP] | Japan | 63-255344 |
| Oct. 11, 1988 | [JP] | Japan | 63-255346 |
| Oct. 12, 1988 | [JP] | Japan | 63-258279 |

[51] Int. Cl.[5] ..... D03D 47/34

[52] U.S. Cl. ..... 139/450; 242/35.5 A; 242/131.1

[58] Field of Search ..... 139/450, 452, 453; 242/35.5 A, 131, 131.1

[56] References Cited

U.S. PATENT DOCUMENTS

| | | | |
|---|---|---|---|
| 3,168,911 | 2/1965 | Pfarrwaller et al. | 139/450 |
| 3,773,274 | 11/1973 | Wildi | 242/131.1 |
| 4,358,068 | 11/1982 | Weiss | 242/131 |
| 4,658,866 | 4/1987 | Takegawa | 139/452 X |
| 4,739,611 | 4/1988 | Rohner | 242/35.5 A X |
| 4,783,021 | 11/1988 | Nagasawa | 242/35.5 A X |

FOREIGN PATENT DOCUMENTS 61-47849 3/1986 Japan .

*Primary Examiner*—Andrew M. Falik

*Attorney, Agent, or Firm*—Oblon, Spivak, McClelland, Maier & Neustadt

[57] ABSTRACT

A yarn package changing method and an apparatus for carrying out the same, for use in combination with a loom which receives the weft yarn from a yarn package. The yarn package changing method carries out automatic yarn package changing operation through steps of removing an empty bobbin set in a yarn package changing position on a yarn package stand, by a yarn package transporting device, supplying a new yarn package to the yarn package stand by the yarn package transporting device, holding the leading end of the new yarn package at a predetermined position by a leading end positioning device; and setting the new yarn package in a feeding position on the yarn package stand. The apparatus includes a yarn package stand capable of holding a yarn package in a feeding position to feed the weft yarn to an automatic weft yarn threading device, a yarn package transporting device capable of automatically mounting a new yarn package on and removing a used yarn package from the yarn package stand, and a leading in positioning device for holding the leading end of a new yarn package mounted on the yarn package stand at a predetermined position, disposed opposite the automatic weft yarn threading device.

20 Claims, 10 Drawing Sheets

AUTOMATIC WEFT YARN PACKAGE CHANGING SYSTEM

BACKGROUND OF THE INVENTION

1. Field of the Invention

The present invention relates to a yarn package changing apparatus and a yarn package changing method for supplying a yarn package of weft yarn to a loom.

2. Discussion of the Background

The applicant for patent on the present invention has previously proposed an automatic weft yarn threading apparatus in J. P. Provisional Pub. (Kokai) No. 61-47849 (corresponding to U.S. Pat. No. 4,658,866). This previously proposed automatic weft yarn threading apparatus is capable of automatically restarting the loom by finding the leading end of the weft yarn of a new yarn package, unwinding the weft yarn from the new yarn package and threading the weft yarn on the loom when the loom is stopped due to the exhaustion of a yarn package presently supplying a weft yarn or upon the breakage of a weft yarn while the loom is in operation.

This known technique enables a smooth and automatic supply package changing operation for changing the supply of a weft yarn from a yarn package supported on a yarn package stand for the supply of a weft yarn from a new package supported on the yarn package stand. However, the previously proposed yarn package changing apparatus is unable to automatically change a used yarn package for a new package and hence unable to achieve fully automated weft yarn supply operation. In this specification, "used yarn package" is the general designation of exhausted yarn packages, i.e., empty bobbins, and half used yarn packages having some amount of yarn and yet to be replaced with a new yarn package.

In replenishing the loom with a new yarn package, it is essential to ensure finding the leading end of the weft yarn wound on the new yarn package and to introduce the leading end into the automatic weft yarn threading apparatus. To secure the precise weft yarn threading operation of the automatic weft yarn threading apparatus, one method employs a yarn transfer device disposed opposite to the automatic weft yarn threading apparatus, for positioning the leading end of the weft yarn near the automatic weft yarn threading apparatus in a predetermined shape to enable the automatic weft yarn threading apparatus to pull in the weft yarn. Another method employs a suction pipe having a flared inlet end which sucks the leading end of the weft yarn lying in a natural position on the circumference of the yarn package and introduces the leading end to the automatic weft yarn threading apparatus. The reliability of the former method in threading a weft yarn is higher than that of the latter method, because the former method grips the leading end of the weft yarn mechanically for positive introduction of the leading end to the automatic weft yarn threading apparatus.

SUMMARY OF THE INVENTION

Accordingly, it is the principal object of the present invention to provide an apparatus and a method capable of automatically changing a used yarn package for a new yarn package to supply a weft yarn to a loom.

More specifically, it is a first object of the present invention to provide a yarn package transporting device for removing a used yarn package and supplying a new yarn package to a yarn package stand with the leading end of the weft yarn pulled out.

It is a second object of the present invention to provide a yarn package stand capable of holding a new yarn package in a yarn feeding position for the smooth feeding of the weft yarn to the loom and to provide a yarn package changing method capable of surely and quickly changing a used yarn package for a new yarn package.

It is a third object of the present invention to provide a leading end positioning device capable of setting the leading end of a weft yarn unwound from a new yarn package at a predetermined position to introduce the leading end to the automatic weft yarn threading apparatus of a loom.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
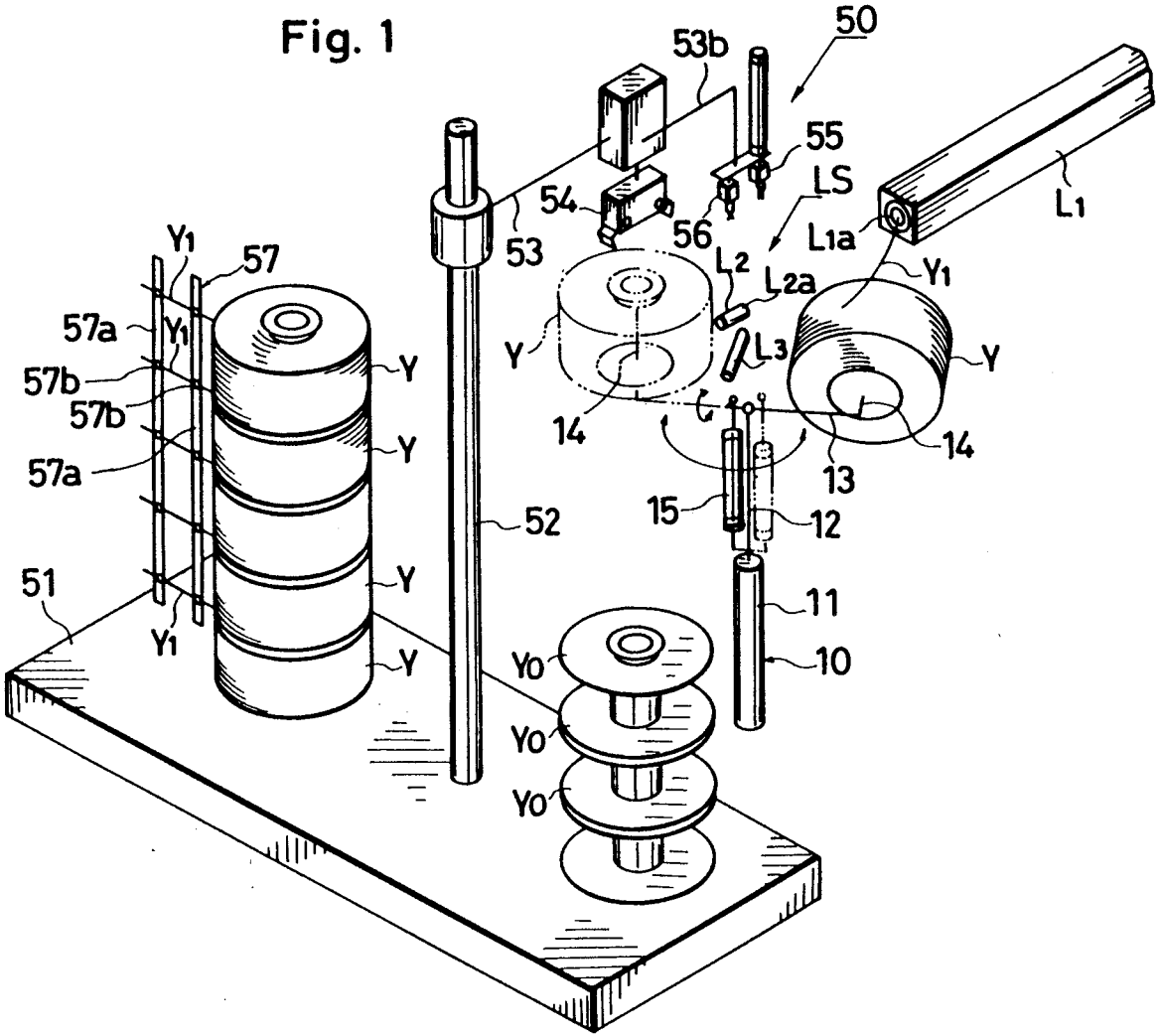
FIG. 1 is a schematic perspective view showing the general structure of a yarn package changing apparatus embodying the present invention.

Typical embodiments of the present invention will be described hereinafter with reference to the accompanying drawings, in which like or corresponding parts are denoted by the same reference characters.

Referring to FIG. 1, a yarn package changing apparatus comprises a yarn package transporting device 50, first and second yarn package stands 10, only one of which is shown, and a leading end positioning device LS. The yarn package changing apparatus changes a used yarn package (hereinafter designated as "empty bobbin") $Y_0$ supported on the yarn package stand 10 for a new yarn package Y. Indicated at $L_1$ is the suction pipe of an automatic weft yarn threading device provided in combination with a loom. The suction pipe $L_1$ sucks the leading end $Y_1$ of the new yarn package Y supported on the yarn package stand 10 to feed the weft yarn from the new yarn package Y to the loom. The loom is a shuttleless loom, such as an air jet loom or a water jet loom.

Figure 3:
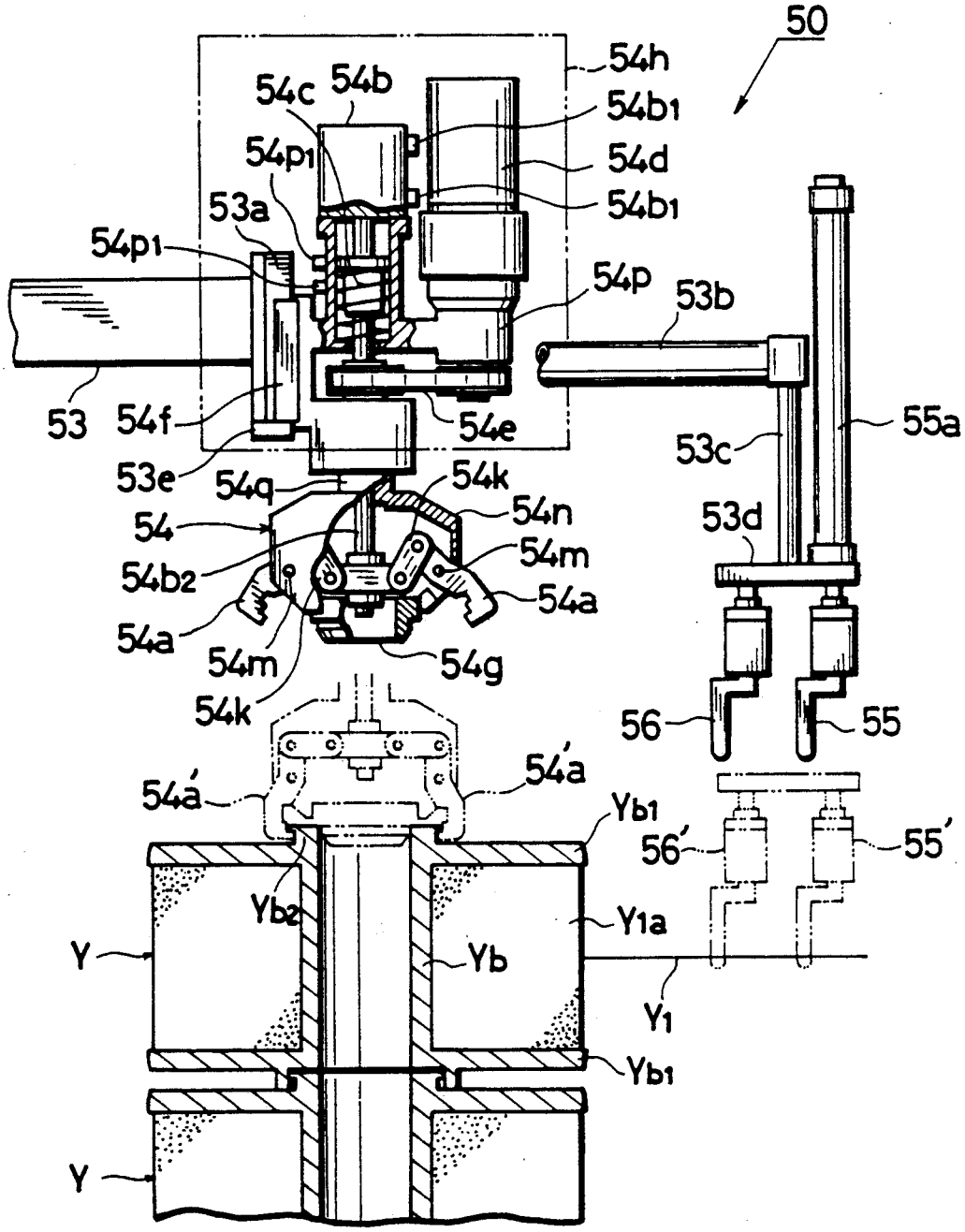
FIG. 3 is a partially cutaway side elevational view of a yarn package transporting device embodying the present invention.

Referring to FIG. 3, the yarn package transporting device 50 has, as principal units, a bobbin holding unit 54 and a pinch unit 55. The bobbin holding unit 54 and the pinch unit 55 are provided respectively on a box-shaped case attached to the extremity of a swing arm 53, and an auxiliary arm 53*b* extending from the side wall of the box-shaped case 54*h*. The swing arm 53 is supported on a post 52 both for vertical movement along the post 52 and for swing motion on the post 52.

As shown in FIG. 3, the bobbin holding unit 54 held for vertical movement on a slider 54*f* vertically slidably engaging a vertical slide base 53*a* attached to the extremity of the swing arm 53; that is, the slider 54*f* is a base member for holding the bobbin holding unit 54 and is vertically slidable on the slide base 53*a*. The lowermost position of the slider 54*f* on the slide base 53*a* is limited by a stopper 53*e* provided at the lower end of the slide base 53*a*.

The bobbin holding unit 54 comprises a pair of gripping fingers 54*a* supported for swing motion opposite to each other, a pneumatic cylinder actuator 54*b* for operating the pair of gripping fingers 54*a*, and a motor 54*d* for rotatively driving the gripping fingers 54*a*. The base ends of the gripping fingers 54*a* are connected through link plates 54*k* to the actuating rod $54b_2$ of the pneumatic cylinder actuator 54*b*. The gripping fingers 54*a* are pivotally supported at the middle portions thereof by pins 54*m* on a holder case 54*n*. The free ends of the gripping fingers 54*a* are bent inward in the shape of a hook conforming to the shape of the ring-shaped gripping head $Yb_2$ of the bobbin Yb of the yarn package Y. The holder case 54*n* is provided on the lower surface thereof with a stepped protrusion 54*g* fitting the bore of the bobbin of the yarn package Y.

A holding member 54*p* for holding both the pneumatic cylinder actuator 54*b* and the motor 54*d* is provided with sensors $54p_1$ to detect the arrival of the bobbin holding unit 54 at the uppermost position and the lowermost position through the detection of the upper end of the slide base 53*a*. The holding member 54*p* is provided internally with a spring 54*c* to bias a rod $54b_2$ constantly upward. The sensors $54p_1$ also detect the extension of the spring 54*c* to the limit of extension and the contraction of the same to the limit of contraction respectively.

The motor 54*d* held on the holding member 54*p* drives the gripping fingers 54*a* through a belt 54*e* for rotation in a horizontal plane. A shaft 54*q* extending upward from the upper end of the holder case 54*n* is journaled for rotation on the holding member 54*p*. The actuating rod $54b_2$ of the pneumatic cylinder actuator 54*b* penetrates the shaft 54*q* axially. The belt 54*e* is wound round a belt pulley fixed to the upper end of the shaft 54*q*.

The pneumatic cylinder actuator 54*b* and the motor 54*d* are contained entirely in the box-shaped case 54*h*, and the auxiliary arm 53*b* is fixed at one end thereof to the side wall of the case 54*h*.

A suspending rod 53*c* is fixed at the upper end thereof to the extremity of the auxiliary arm 53*b*, and a base plate 53*d* is fixed to the lower end of the suspending rod 53*c*. The pinch unit 55 and a guide unit 56 are attached to the lower surface of the base plate 53*d* so as to extend downward. The pinch unit 55 is more remote from the bobbin holding unit 54 than the guide unit 56. The pinch unit 55 is moved vertically by a pneumatic cylinder actuator 55*a*. The bobbin holding unit 54, the pinch unit 55 and the guide unit 56 are disposed in alignment with a straight line passing the axis of swing motion of the swing arm 53.

Figure 5:
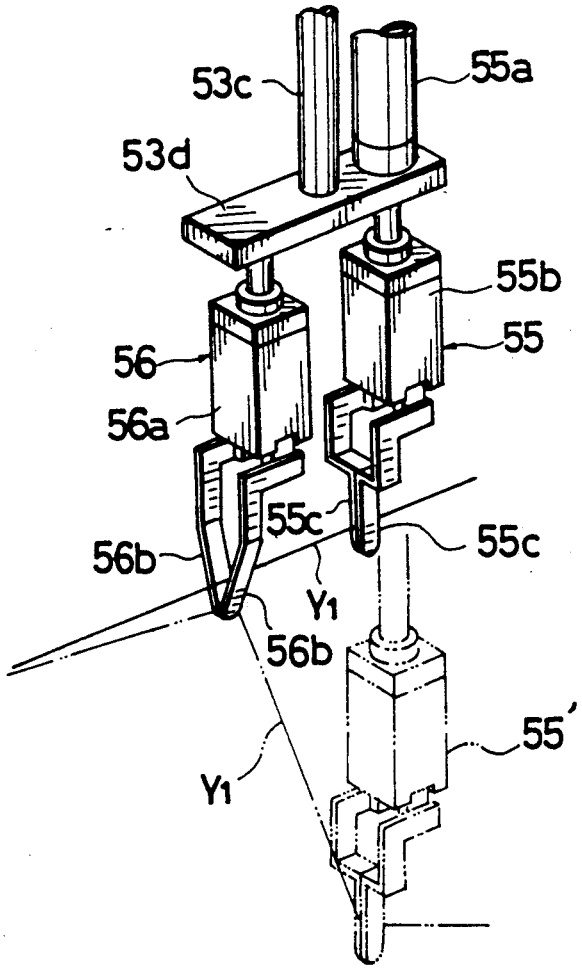
FIG. 5 is a perspective view of a leading end clamping device included in the yarn package transporting device of FIG. 3.

Referring to FIG. 5, the pinch unit 55 has a pair of pinching members 55*c* which are moved away from and toward each other by a pneumatic cylinder actuator 55*b*. The guide unit 56 has a pair of guide members 56*b* which are moved away from and toward each other by a pneumatic cylinder actuator 56*a*. The pinching members 55*c* are moved toward each other so that the respective parallel lower portions are pressed against each other to grip the leading end $Y_1$ of the weft yarn. The respective lower portions of the guide members 56*b* are bent obliquely inward so that the lower portions form a shape resembling the letter V when the guide members 56*b* are pressed against each other to hold the leading end $Y_1$ therebetween.

When the actuating rod of the pneumatic cylinder actuator 55*a* is retracted, the pinch unit 55 and the guide unit 56 are substantially on the same level and, preferably, the extremities of the pinching members 55*c* and those of the guide members 56*b* are positioned below the level of the extremities of the gripping fingers 54*a* of the bobbin holding unit 54 by a distance corresponding to approximately half the height of the yarn package Y to be transported. The pinching unit 55 may comprise a suction pipe capable of sucking the leading end $Y_1$.

As shown in FIG. 3, the yarn package Y to be transported has yarn layers $Y_{1a}$ formed by winding a weft yarn around a bobbin Yb provided with flanges $Yb_1$ at the opposite ends thereof. The gripping head $Yb_2$ is formed at the upper end of the bobbin Yb. As shown in FIG. 1, the leading end of the weft yarn of the yarn package Y is unwound from the yarn package Y before transporting the yarn package Y to the weft yarn feeding position by a length suitable for the pinching unit 55 to grip the leading end, and the leading end is held in a horizontal position by a yarn holding device 57. The yarn holding device 57 has posts 57*a* provided with elastic yarn holding members and threading grooves.

Figure 2:
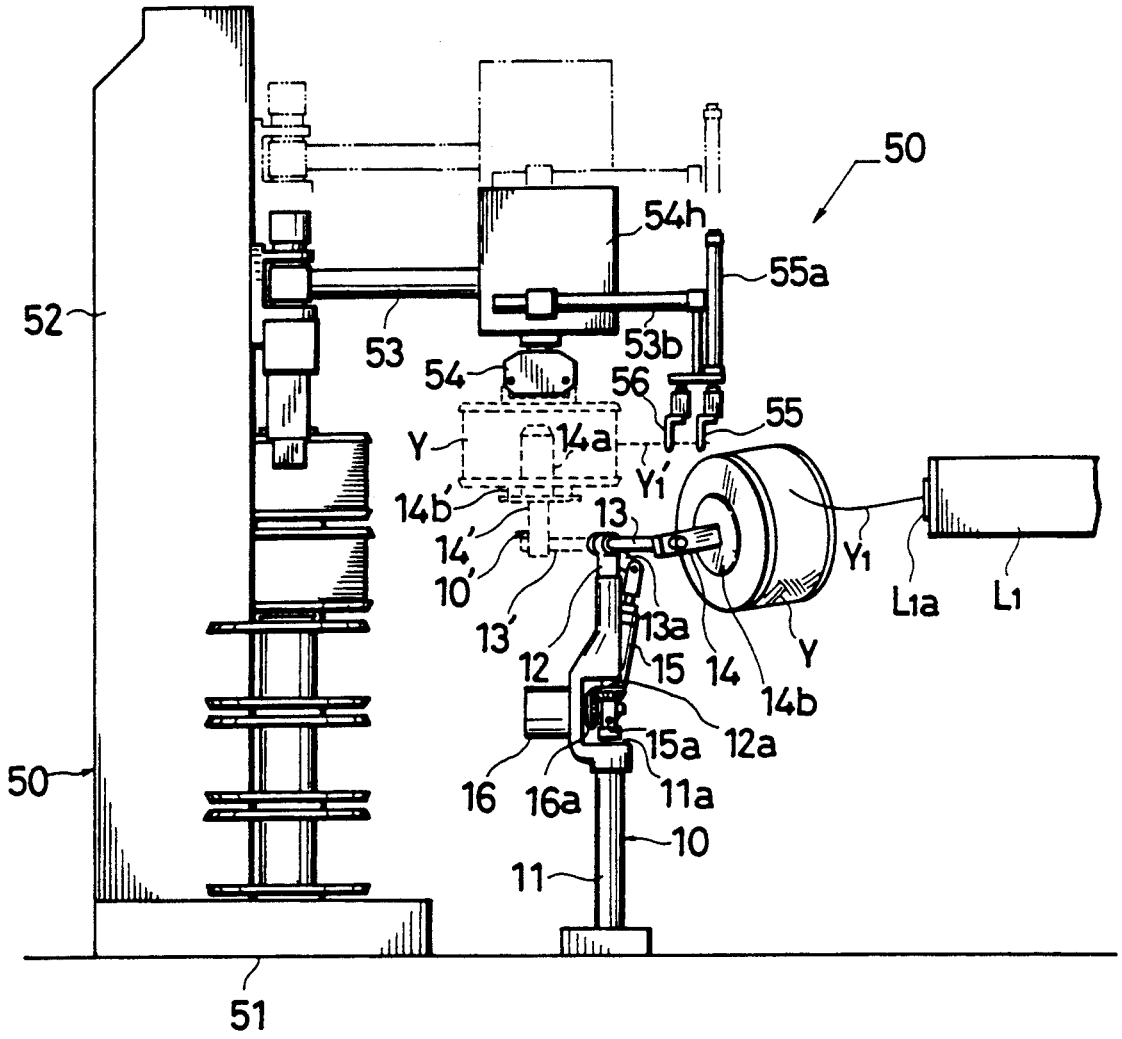
FIG. 2 is a side elevational view of a yarn package transporting device and a yarn package stand embodying the present invention.

In transporting the yarn package Y, the yarn package transporting device 50 is set in a standby state by moving the swing arm 53 to an upper position, where the gripping fingers 54*a* of the bobbin holding unit 54 is on a level above that of the upper end of the bobbin Yb of the yarn package Y, as indicated by imaginary lines in FIG. 2 by a known lifting mechanism, such as a cylinder actuator, opening the gripping fingers 54*a* of the bobbin holding unit 54 as indicated by continuous lines in FIG. 3, opening the pinching members 55*c* of the pinch unit 55, and opening the guide members 56*b* of the guide unit 56. In the standby state, the actuating rod of the pneumatic cylinder actuator 55*a* is retracted so that the pinch unit 55 and the guide unit 56 are held on the same level.

The swing arm 53 is swung to position the bobbin holding unit 54 so that the bobbin holding unit 54 and the yarn package Y are in coaxial alignment, and then the swing arm 53 is moved downward. As the swing arm 53 moves downward, the stepped protrusion 54*g* of the bobbin holding unit 54 is received in the bore of the bobbin Yb of the yarn package Y, and further downward movement of the bobbin holding unit 54 together with the swing arm 53 is stopped. As the swing arm moves further downward, the bobbin holding unit 54 moves upward together with the slider 54*f* relative to the slide base 53*a* fixed to the swing arm 53. Upon detection of the upper end of the slide base 53*a* by the sensor $54p_1$, downward movement of the swing arm 53 is stopped. Since the slider 54*f*, and hence the bobbin holding unit 54, is able to move upward relative to the slide base 53*a* fixed to the swing arm 53, control operation for stopping the swing arm 53 need not be very accurate and there is no possibility that the yarn package Y is exposed to an excessively high pressure.

Then, the actuating rod $54b_2$ of the pneumatic cylinder actuator 54*b* is retracted to grip the bobbin Yb of the yarn package Y with the gripping fingers 54' as indicated by imaginary lines in FIG. 3. That is, upward movement of the actuating rod $54b_2$ of the pneumatic cylinder actuator 54*b* turns the gripping fingers 54*a* on the pins 54*m* through the link plates 54*k* so that the lower ends of the gripping fingers 54*a* move toward each other. Therefore, the hooks formed at the lower ends of the gripping fingers 54*a* engage the gripping head $Yb_2$ of the bobbin Yb of the yarn package Y to hold the yarn package Y when the actuating rod $54b_2$ of the pneumatic cylinder actuator 54*b* is retracted. Since the actuating rod $54b_2$ is biased constantly upward, namely, in the direction of retraction, there is no possibility that the gripping fingers 54*a* are disengaged accidentally from the gripping head $Yb_2$ and the yarn package Y falls off the bobbin holding unit 54, even if the air pressure applied to the active chamber of the pneumatic cylinder actuator is removed after the gripping fingers 54*a* have gripped the gripping head $Yb_2$ of the bobbin Yb.

When the yarn package Y is held by the bobbin holding unit 54, the pinch unit 55 is positioned at a position where the pinching members 55*c* are able to pinch the leading end $Y_1$ extending horizontally from the yarn package Y, and the guide unit 56 is positioned at a position where the guide members 56*b* are able to receive the leading end $Y_1$ therebetween. Then, the pneumatic cylinder actuators 55*b* and 56*a* are actuated to close the pinching members 55*c* and the guide members 56*b* to pinch the leading end $Y_1$ with the pinching members 55*c* and to close the guide members 56*b* in a shape resembling the letter V. Then, the swing arm 53 is elevated along and swung on the post 52 to transport the yarn package Y to a desired position with the leading end $Y_1$ of the yarn package Y held ready to be threaded.

The motor 54*d* is actuated after lifting up the yarn package Y by elevating the swing arm 53 to stretch the leading end $Y_1$ in a straight line between the yarn package Y and the pinch unit 55 under a fixed tension. That is, the bobbin holding unit 54 is rotated through the belt 54*e* by the motor 54*d* to rotate the yarn package Y in a winding direction. The tension of the leading end $Y_1$ can be adjusted to a fixed value by pinching the leading end $Y_1$ so that the leading end $Y_1$ is allowed to slip relative to the pinching fingers 55*c* when a tension exceeding the fixed tension is applied to the leading end $Y_1$.

The yarn package transporting device 50 transports the yarn packages Y to the yarn package stands 10.

As shown in FIG. 2, each of the yarn package stands 10 includes a post 11, a rotary shaft 12 supported coaxially with the post 11, an arm 13 journaled on the upper end of the rotary shaft 12 so as to extend perpendicularly to the rotary shaft 12, and a yarn package support peg 14 attached to one end, i.e., the free end, of the arm 13. The yarn package support peg 14 has a support part 14*a* of an increased diameter to be received in the bore of the bobbin Yb of the yarn package Y. A flange 14*b* is attached to the lower end of the support part 14*a* to receive the bobbin Yb thereon.

Figure 10:
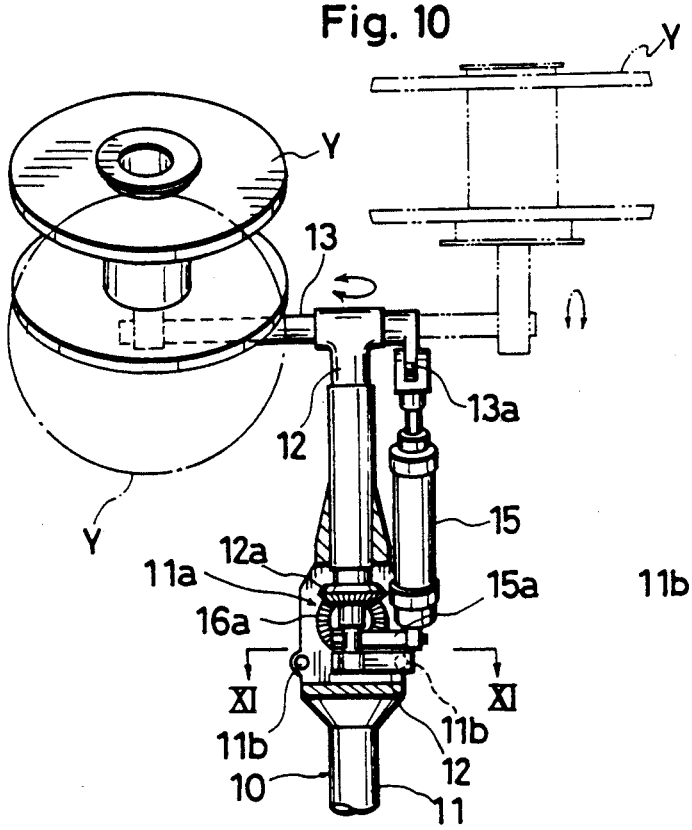
FIG. 10 is a view of assistance in explaining an essential portion of the yarn package stand of FIG. 2.
Figure 11:
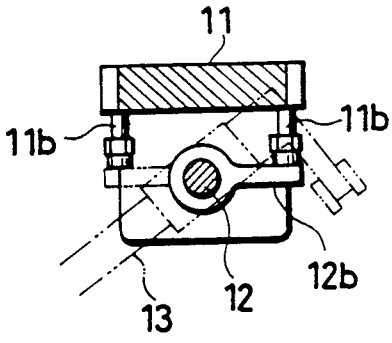
FIG. 11 is a sectional view taken on line XI—XI in FIG. 10.

As shown in FIG. 10, a recess 11*a* is formed in the middle portion of the post 11. A bevel gear 12*a* is attached to the lower end of the rotary shaft 12 projecting into the recess 11*a*. A pin 15*a* has one end fixed to the lower end of the rotary shaft 12, and the other end pivotally joined to the lower end of a pneumatic cylinder actuator 15. The extremity of the actuating rod of the pneumatic cylinder actuator 15 is joined pivotally to a lever 13*a* projecting from the other end of the arm 13. A bevel gear 16*a* is rotatably supported in the recess 11*a* so as to engage the bevel gear 12*a*. The bevel 16*a* is rotatably driven by a motor 16 (FIG. 2) to turn the rotary shaft 12 on the post 11. A stopper 12*b* is attached to the lowermost end of the rotary shaft 12. As shown in FIG. 11, stopper bolts 11*b* are fixed to the post 11 so as to engage the stopper 12*b* at the opposite limits of turning motion of the rotary shaft 12 to define the turning range of the rotary shaft 12.

The rotary shaft 12 can be turned through the bevel gears 16*a* and 12*a* by the motor 16 in the directions indicated by the arrows in FIG. 10 to swing the arm 13 in a horizontal plane. The arm 13 is swung about its axis by operating the pneumatic cylinder actuator 15 to tilt the yarn package support peg 14 at a desired inclination within a vertical plane including the axis of the yarn package support peg 14.

The arm 13 is turned about its axis by the pneumatic cylinder actuator 15 to set the support part 14*a* in an upright position as indicated by broken lines in FIG. 2, the rotary shaft 12 is turned to one of the limits of turning motion to position the support part 14*a* directly below and coaxially with the bobbin holding unit 54, and then the swing arm 53 is lowered and the new yarn package Y held by the bobbin holding unit 54 is released to support the new yarn package Y on the support part 14*a* with the support part 14*a* received in the bore of the bobbin Yb of the new yarn package Y. The empty bobbin $Y_0$ is removed from the support part 14*a* by the yarn package transporting device 50 before putting the new yarn package Y on the support part 14*a*.

The yarn package changing position is common to the first and second yarn package stands 10. In transporting the yarn package Y from the yarn package transporting device 50 to the yarn package stand 10, the leading end $Y_1$ is transported from the pinch unit 55 to the leading end positioning device LS.

Figure 4:
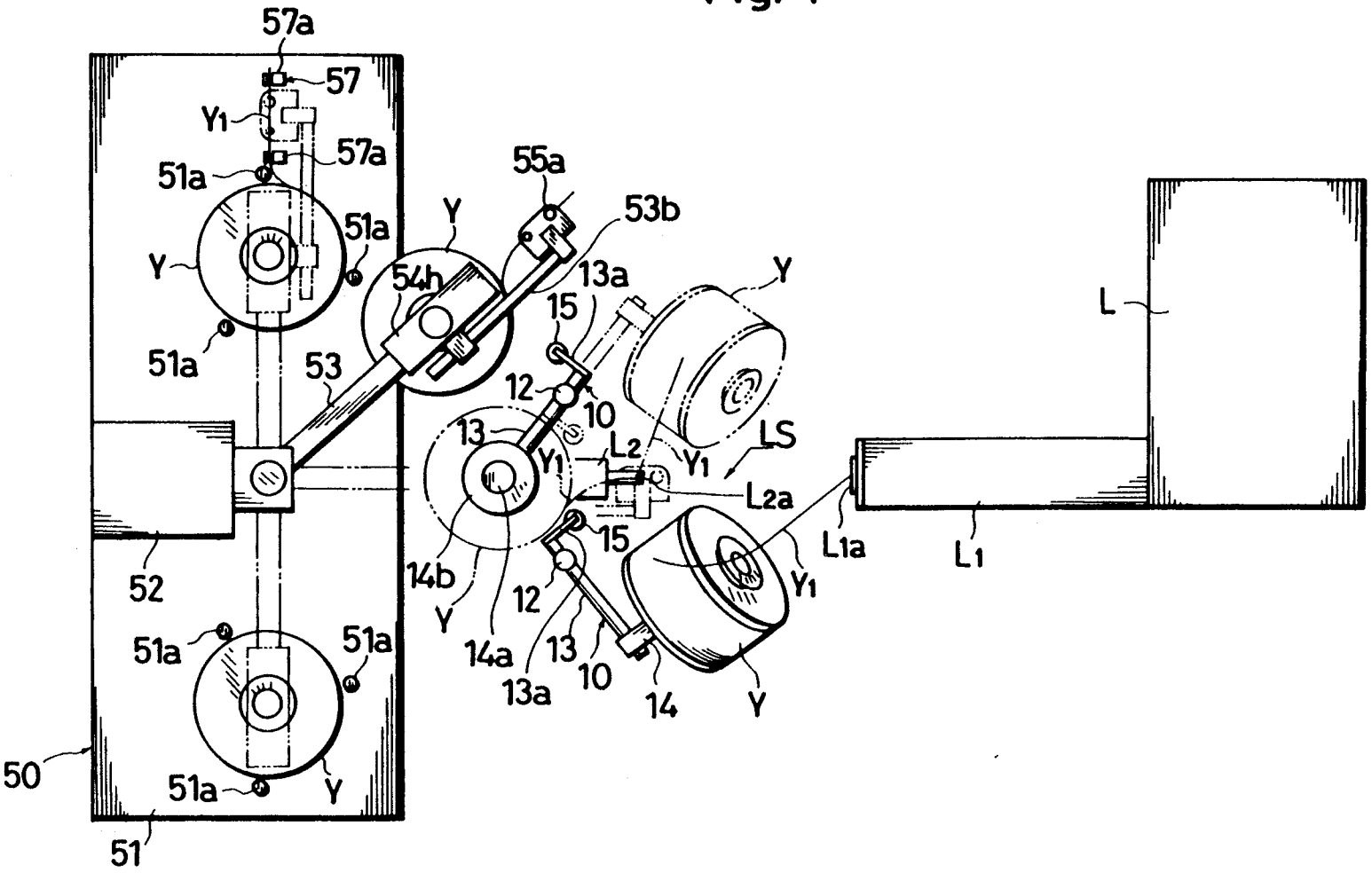
FIG. 4 is a plan view of assistance in explaining the operation of a yarn package transporting device and a yarn package stand embodying the present invention.
Figure 6:
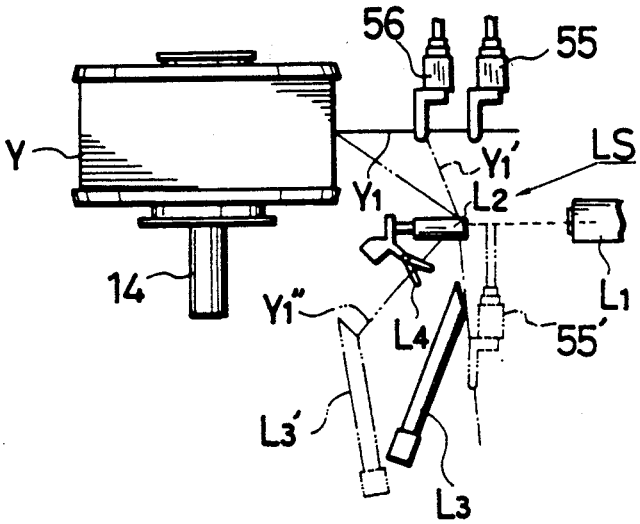
FIG. 6 is a side elevational view of assistance in explaining a leading end positioning device embodying the present invention.

Referring to FIGS. 1, 4 and 6, a tubular positioning member $L_2$ is disposed fixedly near the suction pipe $L_1$ of the automatic weft yarn threading device combined with the loom. A notch $L_2a$ is formed in the extremity of the positioning member $L_2$ to hold the leading end $Y_1$. A swing suction pipe $L_3$ having a suction opening $L_3a$ for sucking the free portion of the leading end $Y_1$ therethrough is disposed under the positioning member $L_2$. Preferably, a cutter $L_4$ for cutting the leading end $Y_1$ in an appropriate length is provided between the positioning member $L_2$ and the suction pipe $L_3$.

In FIG. 6, the yarn package Y held by the bobbin holding unit 54 of the yarn package transporting device 50 has been put on the support part 14*a* of the yarn package support peg 14 of the yarn package stand 10. In this state, the auxiliary arm 53*b* is positioned immediately above the positioning member $L_2$, the leading end $Y_1$ is extended over the positioning member $L_2$ through the guide unit 56 between the yarn package Y and the pinch unit 55. The actuating rod of the pneumatic cylinder actuator 55*a* is extended to lower the pinch unit 55 pinching the leading end $Y_1$ to a position indicated at 55', so that part of the leading end $Y_1$ is positioned near the suction opening $L_3a$ of the suction pipe $L_3$. Then, the pneumatic cylinder actuator 55*b* is actuated to open the pinching members 55*c*, so that the leading end $Y_1$ is sucked into the suction pipe $L_3$. Then, the suction pipe $L_3$ is moved to a position $L_3'$ to put part of the leading end $Y_1$ in the notch $L_2a$ of the positioning member $L_2$ In transferring the leading end $Y_1$ to the suction pipe $L_1$ of the automatic weft yarn threading device, cutting the free portion of the leading end $Y_1$ at a position between the positioning member $L_2$ and the suction pipe $L_3$ facilitates transferring the leading end $Y_1$ to the suction pipe $L_1$ of the automatic weft yarn threading device by a transfer rod.

Figure 7:
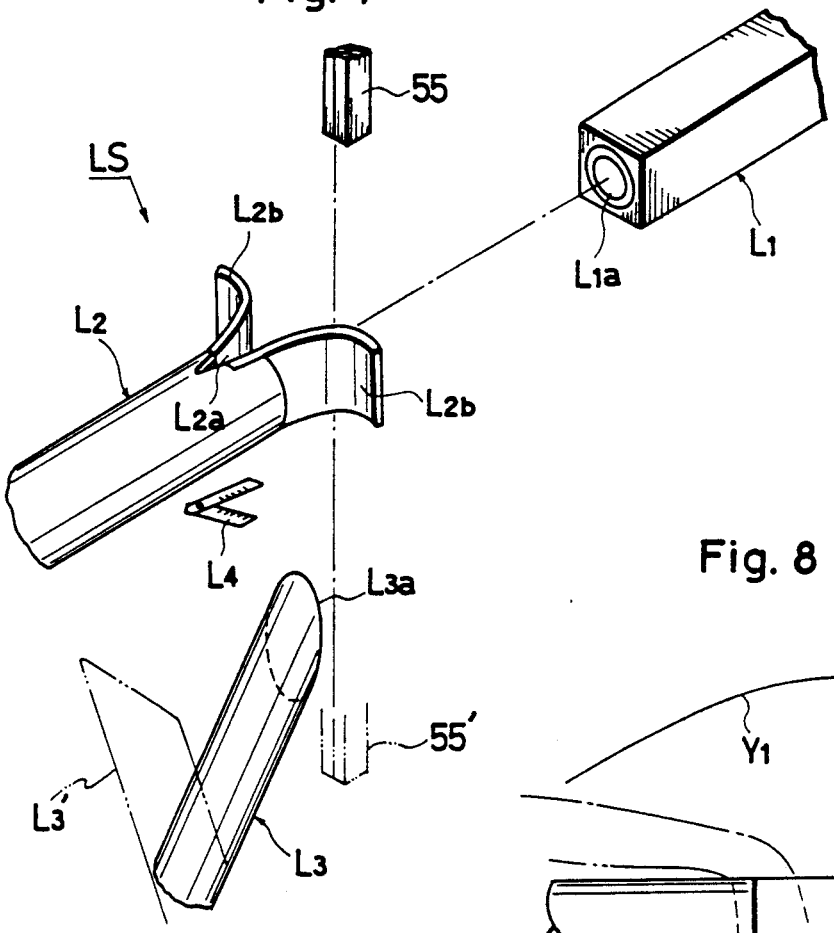
FIGS. 7 and 8 are illustrations of assistance in explaining the operation of a leading, end positioning device.
Figure 8:
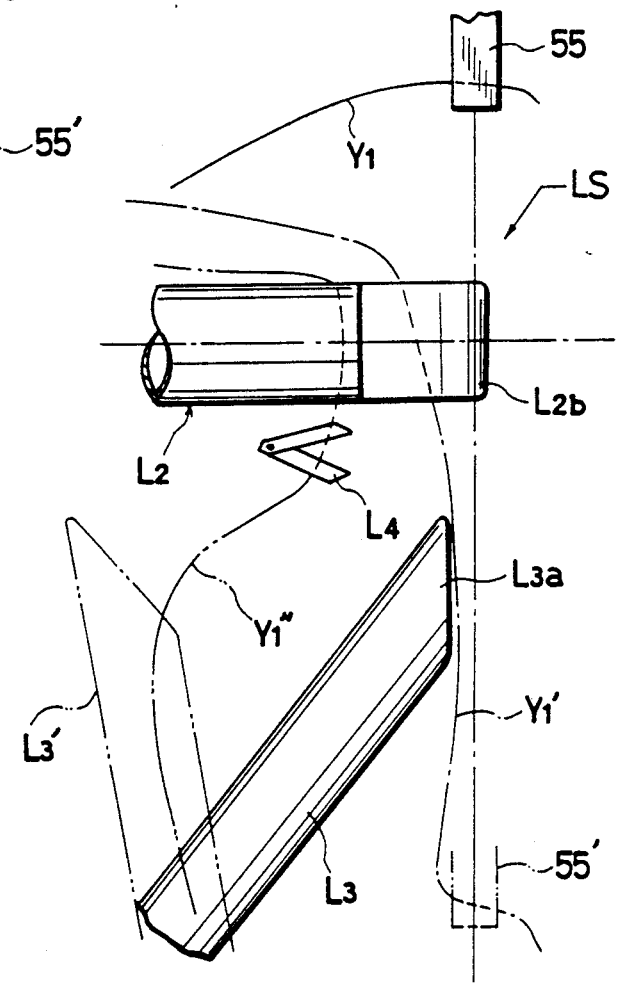
Figure 9:
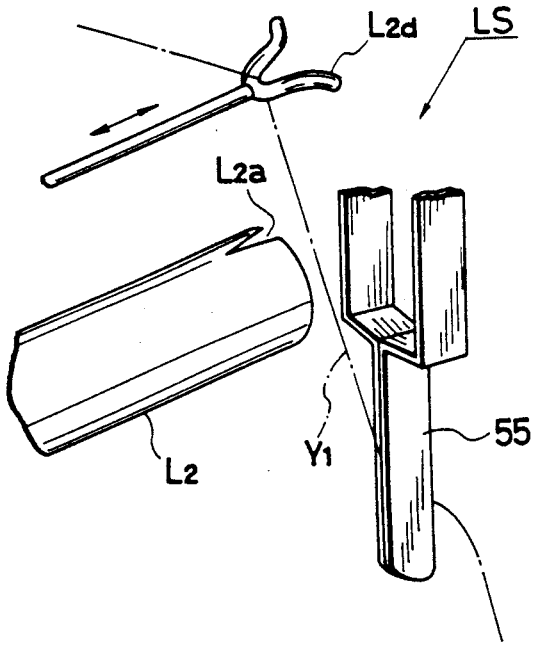
FIG. 9 is a perspective view of assistance in explaining a leading end positioning device in another embodiment according to the present invention.

Referring to FIG. 9 showing a leading end positioning device LS in another embodiment according to the present invention, the leading end positioning device LS employs a retractable guide member $L_2d$ having a shape resembling the letter Y to guide the leading end $Y_1$ surely to the notch $L_2a$ of a positioning member $L_2$. The guide member $L_2d$ may be substituted by a guide member $L_2$ as shown in FIG. 7 having bifurcate guide lips $L_2b$ at the extremity thereof. The positioning member $L_2$ may be such as movable toward and away from the suction pipe $L_1$ of the automatic weft yarn threading device.

The yarn package changing operation of the yarn package transporting device 50, the leading end positioning device LS and the two yarn package stands 10 will be described hereinafter.

New yarn packages Y and empty bobbins $Y_0$ are stacked up respectively at two stacking positions. The swing arm 53 positions the bobbin holding unit 54 directly above the stacking positions. Three guide posts 51*a* are set upright around each of the stacking positions so as to surround the new yarn packages Y and the empty bobbins $Y_0$ stacked up at the stacking positions to keep the respective stacks of new yarn packages Y and empty bobbins $Y_0$ securely in place. As shown in FIG. 4, the yarn holding device 57 is disposed beside the stacking position for new yarn packages under the extension of the swing arm 53. As shown in FIG. 1, the leading ends $Y_1$ of the new yarn packages Y are extended under tension between the two posts 57*a* of the yarn holding device 57 so as to be picked up.

Suppose that a new yarn package Y in a feed position on the first yarn package stand 10 is an active yarn package (a yarn package indicated by continuous lines in FIG. 4), namely, a yarn package currently feeding a weft yarn to the loom, and the other yarn package (a yarn package indicated by imaginary lines in FIG. 4) in a feed position on the second yarn package stand 10 is a standby yarn package. Upon the exhaustion of the active yarn package Y or the interruption of yarn feed by yarn breakage during the weaving operation of the loom L, the automatic weft yarn threading device changes the weft yarn of the active yarn package for that of the standby yarn package, and then the loom L is restarted automatically. The leading end $Y_1$ of the standby yarn package Y is extended via the notch $L_2a$ of the positioning member $L_2$ between the standby yarn package Y and the swing suction pipe $L_3$ staying at the retracted position. In introducing the leading end $Y_1$ of the weft yarn of the standby yarn package Y into the loom L by the automatic weft yarn threading device, the unnecessary portion of the leading end $Y_1$ is cut off by the cutter $L_4$.

On the other hand, the arm 13 of the first yarn package stand 10 swings about the axis of the rotary shaft 12 and turns about its axis to move the empty bobbin $Y_0$ to the yarn package changing position and to set the empty bobbin $Y_0$ in an upright yarn package changing position. Then, the yarn package transporting device 50 transports the empty bobbin $Y_0$ from the first yarn package stand 10 to the used yarn package stacking position on the base 51 of the yarn package transporting device 50 through steps of elevating the swing arm 53, swinging the swing arm 53 to position the bobbin holding unit 54 directly above the empty bobbin $Y_0$ on the first yarn package stand 10, lowering the swing arm 53 to make the bobbin holding unit 54 engage the gripping head $Yb_2$ of the bobbin of the empty bobbin $Y_0$, holding the empty bobbin $Y_0$ by the bobbin holding unit 54, elevating the swing arm 53 to remove the empty bobbin $Y_0$ from the yarn package support peg 14, swinging the swing arm 53 to position the used empty bobbin $Y_0$ held by the bobbin holding unit 54 directly above the stack of empty bobbins $Y_0$ on the base 51 of the yarn package transporting device 50, lowering the swing arm 53 to place the empty bobbin $Y_0$ on top of the stack of empty bobbins $Y_0$, and releasing the empty bobbin $Y_0$ from the bobbin holding unit 54.

Subsequently, the yarn package transporting device 50 elevates the swing arm 53, swings the swing arm 53 in the opposite direction as shown in FIG. 4 to position the bobbin holding unit 54 directly above the stack of new yarn packages Y, lowers the swing arm 53, and grips the uppermost new yarn package Y by the bobbin holding unit 54. Simultaneously with the yarn package gripping operation of the bobbin holding unit 54, the pinching unit 55 pinches the leading end $Y_1$ extending from the new yarn package Y, and the guide unit 56 closes the guide members 56*b* under the leading end $Y_1$.

Then, the swing arm 53 is elevated and swung again to position the bobbin holding unit 54 directly above the common yarn package changing position. The bobbin holding unit 54 is turned by the motor 54*d* in a winding direction after the pinching unit has pinched the leading end $Y_1$ to extend the leading end $Y_1$ in a predetermined taut state.

Subsequently, the swing arm 53 is lowered to mount the new yarn package Y on the yarn package support peg 14 placed in an upright position. Simultaneously, the actuating rod of the pneumatic cylinder actuator 55*a* is extended to move the pinching unit 55 downward to the position 55' indicated by imaginary lines in FIG. 6, so that the leading end $Y_1$ is bent at the extremity of the guide unit 56 and is moved to a position below the suction pipe $L_3$ positioned at the front standby position passing near the respective extremities of the positioning member $L_2$ and the suction pipe $L_3$. In lowering the pinching unit 55, the bobbin holding unit 54 is turned by the motor 54*d* so that the weft yarn is unwound properly from the new yarn package Y as the pinching unit 55 is moved downward.

Then, the suction pipe $L_3$ becomes active, the pinching unit 55 releases the leading end $Y_1$ and the guide members 56*b* of the guide unit 56 are opened to suck the leading end $Y_1$ into the suction pipe $L_3$ Then, the suction pipe $L_3$ is moved to the retracted position. Consequently, the leading end $Y_1$ is bent by the positioning member $L_2$ and is extended taut between the new yarn package Y and the suction pipe $L_3$ as indicated by an imaginary line in FIG. 6. The notch $L_2$a of the positioning member $L_2$ positions the leading end $Y_1$ accurately. Then, the bobbin holding unit 54 releases the new yarn package Y, and then the swing arm 53 is elevated to separate the bobbin holding unit 53 from the new yarn package Y.

After the new yarn package Y has been mounted on the yarn package support peg 14 of the first yarn package stand 10, the rotary shaft 12 is reversed and the arm 13 is swung to position the new yarn package Y at the common yarn package changing position in a weft yarn feeding position. Thus, the new package Y is reserved on the first yarn package stand 10 as a standby yarn package for the next use. Since the leading end $Y_1$ of the new yarn package Y is extended in a taut state by the suction of the suction pipe $L_3$ during the operation for changing the position of the new yarn package Y, the leading end $Y_1$ never falls off the notch $L_2$a of the positioning member $L_2$. Even if the length of the portion of the leading end $Y_1$ extending between the new yarn package Y and the suction pipe $L_3$ changes due to the variation of the distance between the new yarn package Y and the positioning member $L_2$ in changing the position of the new yarn package Y, the variation in the length can smoothly be absorbed by a portion of the leading end $Y_1$ pulled out from or sucked into the suction pipe $L_3$.

The yarn package stands 10 may be substituted by yarn package stands as shown in FIGS. 12 to 15.

Figure 12:
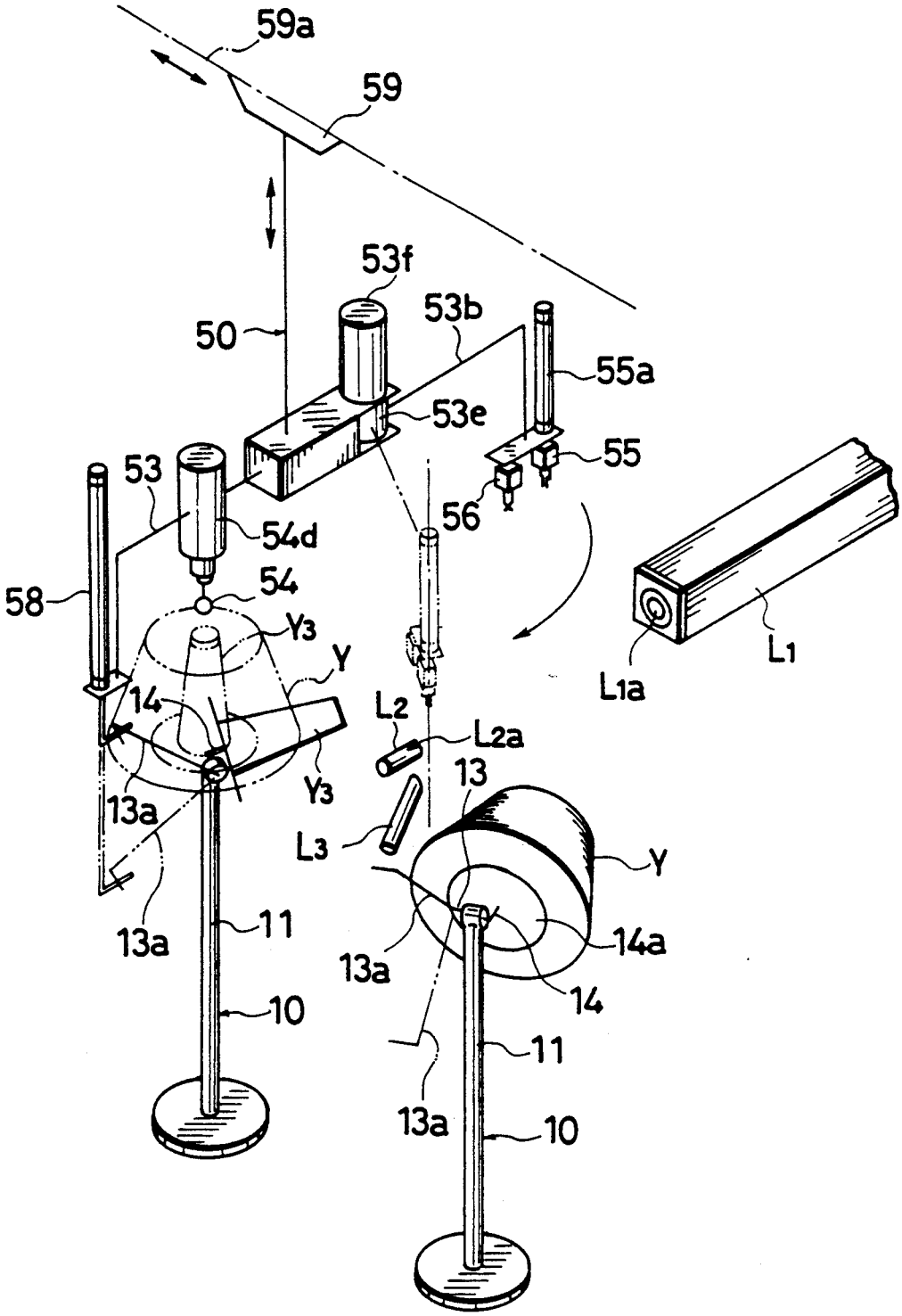
FIGS. 12 to 14 are perspective views of assistance in explaining a yarn package stand in another embodiment according to the present invention.

FIG. 12 shows a pair of yarn package stands 10 in a second embodiment according to the present invention. The yarn package stands 10 shown in FIG. 12 are used when the yarn package support pegs 14 of the yarn package stands 10 need not be moved to a common yarn package changing position for yarn package changing operation. Each yarn package stand 10 has an arm 13 provided with the yarn package support peg 14 at one end thereof. The arm 13 is turned simply about its axis between a position where the yarn package support peg 14 is placed in an upright position, and a position where the same is placed in a tilted position in which the yarn package support peg 14 is directed toward the weft yarn inlet $L_1$a of the suction pipe $L_1$ of the automatic weft yarn threading device. A bend is formed at the extremity of a lever 13*a* attached to the other end of the arm 13. This yarn package stand 10 is used suitably for supporting a cone as shown in FIG. 12.

An overhead traveling yarn package transporting device 50 as shown in FIG. 12 is used in combination with the yarn package stands 10. The traveling yarn package transporting device 50 is suspended from a trolley 59 which travels along an overhead guide rail 59*a*. The traveling yarn package transporting device 50 has a horizontal arm 53 instead of the swing arm 53. The arm 53 does not swing and instead is moved vertically by a known lifting mechanism, not shown. A bobbin holding unit 54 included in the traveling yarn package transporting device 50 employs an elastic bag instead of the gripping fingers 54*a* to hold a yarn package Y. In lifting up a yarn package Y, the elastic bag is inserted in the bore of the bobbin of the yarn package Y, compressed air is supplied into the elastic bag to inflate the same, and then the inflated elastic bag is elevated to lift up the yarn package Y. In releasing the yarn package Y, the air is discharged from the inflated elastic bag to allow the inflated elastic bag to reduce its diameter.

An auxiliary arm 53*b* is extended from a rotary member 53*e* which is turned about a vertical axis by a motor 53*f* to swing the auxiliary arm 53*b* in a horizontal plane so that a pinching unit 55 and a guide unit 56 suspended from the auxiliary arm 53*b* are placed directly above a positioning member $L_2$.

In removing an empty bobbin $Y_0$ from the yarn package stand 10, the traveling yarn package transporting device 50 is stopped upon the arrival of the bobbin holding unit 54 at a position directly above the yarn package stand 10, the horizontal arm 53 is lowered to a predetermined position, the lever 13*a* is turned downward by extending the actuating rod of an pneumatic cylinder actuator 58 to set the empty bobbin $Y_0$ supported on the yarn package support peg 14 of the yarn package stand 10 in an upright position as indicated by imaginary lines in FIG. 12, the actuating rod of the pneumatic cylinder actuator 58 is disengaged from the lever 13*a* by suitable means, such as turning the actuating rod, the horizontal arm 53 is lowered further to insert the elastic bag in the bore of the empty bobbin $Y_0$, the elastic bag is inflated, and then the horizontal arm 53 is elevated to remove the empty bobbin $Y_0$ from the yarn package support peg 14. Then, the traveling yarn package transporting device 50 is moved to transport the empty bobbin $Y_0$ to an empty bobbin storing place.

In putting a new yarn package Y on the yarn package support peg 14 of the yarn package stand 10, the yarn package transporting device 50 picks up a new yarn package Y at a new yarn package storing place, carries the new yarn package Y with the leading end of the weft yarn of the new yarn package Y held by the pinching unit 55 to a position directly above the yarn package support peg 14 placed in an upright position, and puts the new yarn package Y on the yarn package support peg 14 of the yarn package stand 10 simply by lowering the horizontal arm 53. Then, the auxiliary arm 53*b* is swung in a horizontal plane to position the pinching unit 55 near and above the positioning member $L_2$ as indicated by imaginary lines in FIG. 12. Then, the leading end $Y_1$ of the new yarn package Y is extended via the notch $L_2$a of the positioning member $L_2$ between the new yarn package Y and a suction pipe $L_3$ by the same procedure as that employed in positioning the leading end by the aforesaid yarn package transporting device 50.

Then, the lever 13*a* is turned upward by the pneumatic cylinder actuator 58 to set the yarn package support peg 14 supporting the new yarn package Y in the feeding position.

In removing an empty bobbin $Y_0$ from the other yarn package support stand 10 and in putting a new yarn package Y on the same, the yarn package transporting device 50 is moved to a position corresponding to the other yarn package stand 10. Thus, the yarn package support pegs 14 of the yarn package stands 10 need not be positioned at a common yarn package changing position.

Figure 13:
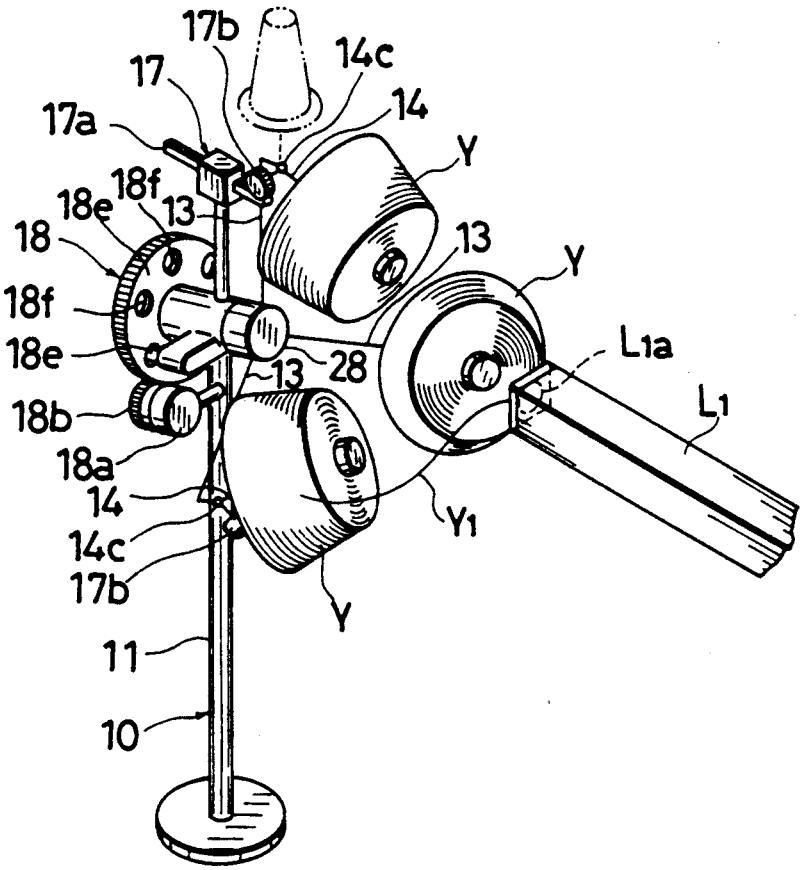

A yarn package stand 10 in a third embodiment according to the present invention is shown in FIG. 13. This yarn package stand 10 comprises a post 11, a rotary block 28 rotatably supported on the post 11, three radial arms 13 radially extending from the rotary block 28, three yarn package support pegs 14 joined to the extremities of the radial arms 13 by hinge joints 14*c*. respectively, a peg operating mechanism 17 comprising a rack 17*a* supported on top of the post 11, and three pinions 17*b* interlocked respectively with the hinge joints 14*c*, and a rotating mechanism 18 comprising a motor 18*a*, a driving gear 18*b* fixed to the output shaft of the motor 18*a*, a driven gear 18*c* engaging the driving gear 18*b*, coaxially connected to the rotary block 28 and provided with recesses 18*f* formed in one surface thereof at equal angular intervals, and a positioning pin 18*e* capable of elastically engaging the recess 18*f*. The rotary block 28 is turned at equal angular intervals of 120° to index the radial arms 13 at predetermined positions including a position where the radial arms 13 are set in an upright position. The rotary block 28 is stopped at the predetermined angular positions by the engagement of the positioning pin 18*e* with the recesses 18*f* formed in the driven gear 18*c*. When each arm 13 is set in an upright position, the rack 17*a* engages and drives the pinion 17*b* to set the yarn package support peg 14 in an upright position as indicated by imaginary lines in FIG. 13. When the arm 13 is in a position other than the upright position, the yarn package support peg 14 is in a feed position in which the yarn package support peg 14 is directed toward the weft yarn inlet $L_1$a of the suction pipe $L_1$ of the automatic weft yarn threading device.

A traveling yarn package transporting device, not shown, to be used in combination with this yarn package stand 10 is substantially the same in construction as that used in combination with the yarn package stands 10 in the second embodiment, except that the horizontal arm 53 is swingable in a horizontal plane and the pneumatic cylinder actuator 58 need not be provided.

Desirably, the yarn package stand 10 is provided with three leading end positioning units, not shown, each provided with a positioning member $L_2$, not shown, capable of being moved toward and away from the suction pipe $L_1$ of the automatic weft yarn threading device. The yarn package stand 10 may be provided with no leading end positioning unit, and may be used in combination with a suction pipe $L_2$, not shown, having a funnelform inlet end entirely covering the yarn package supported on the yarn package support peg 14.

Figure 14:
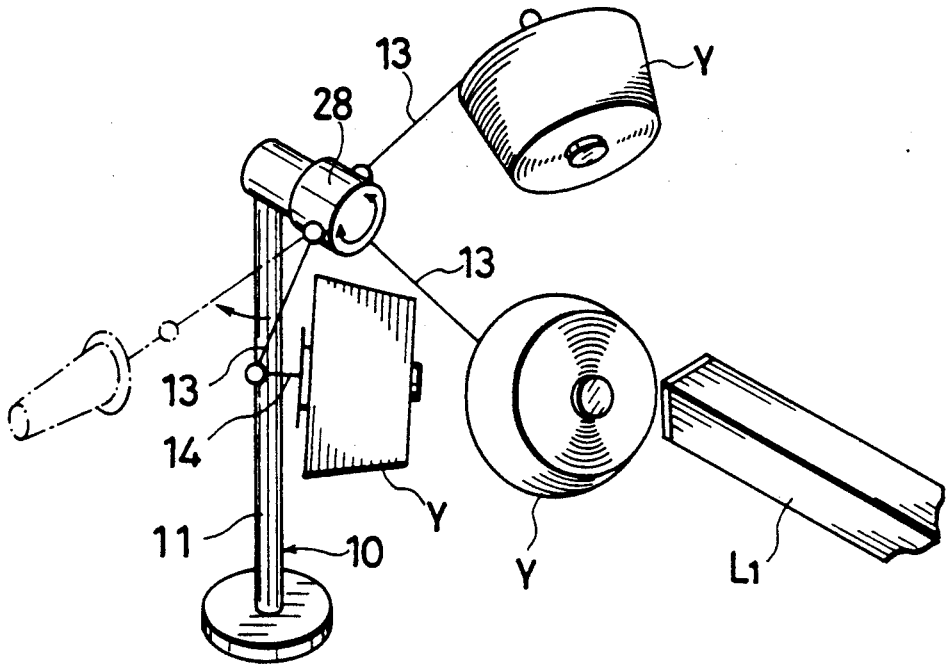

FIG. 14 shows a yarn package stand 10 in a fourth embodiment according to the present invention. This yarn package stand 10 comprises a post 11, a rotary block 28 rotatably supported on the post 11, three radial arms 13 radially extending from the rotary block 28 at equal angular intervals, and three yarn package support pegs 14 joined respectively to the respective extremities of the radial arms 13. The radial arms 13 are swingable on the rotary block 28. The yarn package support pegs 14 are swingable on the extremities of the radial arms 13. When the radial arm 13 is positioned at a yarn package changing position as indicated by imaginary lines in FIG. 15, the yarn package support peg 14 is set in a yarn package changing position A traveling yarn package transporting device 50, not shown, to be used in combination with the yarn package stand 10 travels horizontally to deliver a new yarn package, not shown, to the yarn package support peg 14 set in the yarn package changing position.

Figure 15:
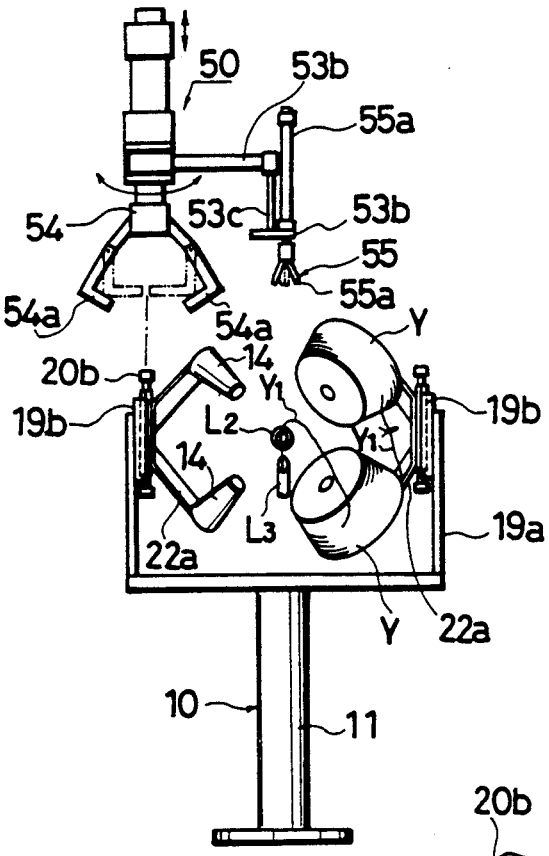
FIG. 15 is a side elevational view of assistance in explaining a yarn package stand in a further embodiment according to the present invention.
Figure 16:
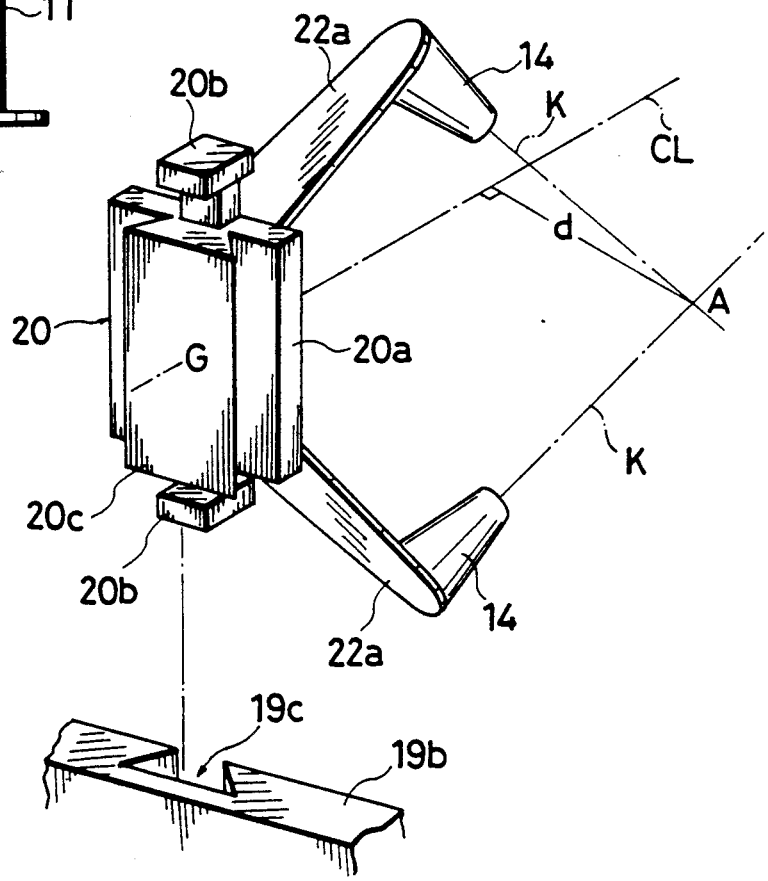
FIG. 16 is a perspective view of the yarn package holding unit shown in FIG. 15.

FIG. 15 shows a yarn package stand 10 in a fifth embodiment according to the present invention. This yarn package stand 10 comprises a post 11, a frame 19*a* having a shape resembling the letter U, fixed to the upper end of the post 11, and having opposite upright base members, a pair of base plates 19*b* attached respectively to the upright base members of the frame 19*a*, and a pair of yarn package support units 20 detachably mounted respectively on the base plates 19*b*, and each comprising a base plate 20*a*, a pair of brackets 22*a* obliquely extending from the front surface of the base plate 20*a* in opposite directions, and yarn package support pegs 14 attached respectively to the respective extremities of the brackets 22*a*. FIG. 16 shows an exemplary means for detachably mounting the yarn package support unit 20 on the corresponding base plate 19*b*. As shown in FIG. 16, a dovetail groove 19*c* is formed in the base plate 19*b*, and a dovetail 20*c* fitting the dovetail groove 19*c* is formed in the backside of the base plate 20*a* of the yarn package support unit 20. Knobs 20*b* are formed respectively at the upper and lower ends of the base plate 20*a*. The gripping fingers 54*a* of the bobbin holding unit 54 of a yarn package transporting device 50 grips the knob 20*b* in removing the yarn package support unit 20 from the base plate 19*b* and transporting the same.

As shown in FIG. 16, the yarn package support pegs 14 are positioned so that the center axis K of the yarn package support pegs 14 intersect each other at a point A positioned at a set distance d from a perpendicular CL to the front surface of the base plate 20*a*, passing the center G of the base plate 20*a*, and approximately on the center axis of the weft yarn inlet opening of the automatic weft yarn threading device to enable the weft yarns of the yarn packages supported on the yarn package support pegs 14 to be unwound smoothly.

The bobbin holding unit 54 of the yarn package transporting device 50 is movable both horizontally and vertically to facilitate removing the yarn package support unit 20 from and putting the same on the base plate 19*b*. The yarn package transporting device 50 employs a swingable auxiliary arm 53*b* holding a pinching unit 55. The swingable auxiliary arm 53*b* swings to transfer the leading end $Y_1$ of a yarn package Y supported on the yarn package support unit 20 to a leading end positioning member $L_2$ in the same manner as that employed in the foregoing embodiments.

Preferably, the trailing end of one of the two yarn packages supported on the yarn package support unit 20 and the leading end of the other yarn package are tied together to feed the weft yarn successively from both the yarn packages. The yarn package stand 10 provided with the two yarn package support units 20 reduces yarn package changing frequency. The use of the yarn package transporting device 50 in combination with the yarn end positioning device enables automatic yarn . package changing operation.

The yarn package transporting device 50 thus constructed changes empty bobbins efficiently and surely for new yarn packages, and the leading end of the new yarn package can accurately be taken to the leading end positioning device by the pinching unit and the guide unit. The yarn package stand holds the yarn package in a feeding position to feed the weft yarn to the loom without hindrance. The leading end positioning device positions successively and accurately the leading ends of yarn packages to be used successively at the predetermined position to ensure the weft yarn threading operation of the automatic weft yarn threading device, so that the lost weaving time necessary for yarn package changing operation is reduced to the least extent.

The yarn package changing apparatus comprising the yarn package transporting device, the yarn package stand or stands, and the leading end positioning device fully enables automatic yarn package changing operation on the loom.

Furthermore, the use of the yarn package stand having the yarn package support units for supporting yarn packages eliminates problems in changing the bobbin holding unit when the yarn packages are changed for those formed on bobbins different from those of the former yarn packages.

Obviously, numerous modifications and variations of the present invention are possible in light of the above teachings. It is therefore to be understood that within the scope of the appended claims, the invention may be practiced otherwise than as specifically described herein.

What is claimed is:

1. A yarn package changing apparatus for a loom which receives a weft yarn through an automatic weft yarn threading device from a yarn package, for changing an empty bobbin for a new yarn package, comprising:

a yarn package stand device including means for holding yarn package in a feeding position to feed the weft yarn to the automatic weft yarn threading device;

a yarn package transporting device including means for automatically mounting a new yarn package on and removing a used yarn package from the yarn package stand device; and a leading end positioning device for holding the leading end of a new yarn package mounted on the yarn package stand device at a predetermined position, disposed opposite the automatic weft yarn threading device.

2. A yarn package changing apparatus according to claim 1, wherein said yarn package transporting device comprises: a revolving bobbin holding unit for holding a yarn package; and a pinching unit having pinching members for pinching the leading end of the yarn package held by the bobbin holding unit.

3. A yarn package changing apparatus according to claim 2, wherein said bobbin holding unit is provided with a plurality of gripping fingers operated by a cylinder actuator for gripping operation, and said bobbin holding unit is driven for rotation through a driving belt by a motor.

4. A yarn package changing apparatus according to claim 2, wherein said pinching unit is connected to a cylinder actuator connected to an auxiliary arm connected to said bobbin holding unit, and a guide unit having guide members for being joined together and spaced apart is provided near the pinching unit on the auxiliary arm.

5. A yarn package changing apparatus according to claim 4, wherein said auxiliary arm is held at one end thereof by a case holding said bobbin holding unit.

6. A yarn package changing apparatus according to claim 1, wherein said leading end positioning device comprises a positioning member provided at the extremity thereof with a notch through which the leading end extends, and a swingable suction pipe disposed near the positioning member.

7. A yarn package changing apparatus according to claim 6, wherein a cutter for cutting the leading end in a set length is disposed between said positioning member and said swingable suction pipe.

8. A yarn package changing apparatus according to claim 6 or 7, wherein a yarn guide of a shape resembling the letter Y for being advanced and retracted in the direction of axis of said positioning member is provided on the side of said yarn package transporting device with respect to said positioning member.

9. A yarn package changing apparatus according to claim 1, wherein said yarn package stand device includes yarn package support pegs each for supporting a yarn package, for being set in a feeding position for feeding yarn from the yarn package supported thereon and in a yarn package changing position for changing the yarn package.

10. A yarn package changing apparatus according to claim 9, wherein said yarn package stand device comprises a pair of yarn package stands each comprising: a post; a rotary shaft coaxially supported on the post; an arm rotatably supported at one end thereof on the upper end of the rotary shaft for rotation about its axis perpendicular to that of the rotary shaft, and provided at the other end thereof with said yarn package support peg; and a cylinder actuator for turning the arm about its axis.

11. A yarn package changing apparatus according to claim 9, wherein said yarn package stand device comprises a pair of yarn package stands each comprising: a post; an arm rotatably supported on the upper end of the post with its axis perpendicular to that of the post; a yarn package support peg fixedly attached to one end of the arm with its axis intersecting that of the arm; and a lever to be operated by a cylinder actuator provided on said yarn package transporting device, fixedly joined to the other end of the arm.

12. A yarn package changing apparatus according to claim 9, wherein said yarn package stand device comprises: a post; a rotary block mounted on the post for rotation about its axis perpendicular to that of the post; a plurality of radial arms radially extending from the rotary block at equal angular intervals; and swingable yarn package support pegs pivotally joined respectively to the extremities of the radial arms.

13. A yarn package changing apparatus according to claim 12, wherein said rotary block is combined with a gear wheel which can be indexed by a positioning pin, the gear wheel is driven for rotation through a gear wheel by a motor, and said yarn package support pegs are combined respectively with pinions which engage with a rack.

14. A yarn package changing apparatus according to claim 1, wherein said yarn package stand comprises: a post; a frame of a shape resembling the letter U, fixed to the upper end of the post, and having a pair of base members; a plurality of base plates provided on the base members; and a plurality of yarn package support units for supporting yarn packages, detachably mounted respectively on the base plates.

15. A yarn package changing apparatus according to claim 14, wherein said yarn package support units each comprises: a slide base for slidably engaging said base plate; a plurality of brackets obliquely extending from the front surface of the slide base; and yarn package support pegs attached respectively to the respective extremities of the plurality of brackets so that the axes thereof converge substantially on a point on the axis of the weft yarn inlet of said automatic weft yarn threading device.

16. A yarn package changing apparatus according to claim 14, wherein the slide base of each of said yarn package support units is provided with a dovetail in the back surface thereof, and a dovetail groove fitting the dovetail of the slide base is formed in each base plate provided on the base member of said frame.

17. A yarn package changing apparatus according to claim 14, wherein said yarn package support units are each provided with knobs to be gripped by the bobbin holding unit of said yarn package transporting device.

18. A yarn package changing method for changing an empty bobbin for a new yarn package on a yarn package stand device combined with a loom, comprising steps of:

changing the position of a yarn package support peg supporting the empty bobbin from a feeding position to a yarn package changing position;

automatically removing the empty bobbin from the yarn package support peg set in the yarn package changing position;

automatically putting the new yarn package on the yarn package support peg set in the yarn package changing position; and setting the yarn package support peg supporting the new yarn package in a the feeding position for feeding yarn from the new yarn package.

19. A yarn package changing method according to claim 18, which comprises transporting the new yarn package to a predetermined position with the leading end thereof gripped, and holding the leading end at a position for transferring the leading end to an automatic weft yarn threading device combined with the loom, in putting the new yarn package on the yarn package support peg set in the yarn package changing position.

20. A yarn package changing method according to claim 18, which comprises supporting a plurality of yarn packages in the feeding position and/or the yarn package changing position, and supporting the yarn packages in the yarn package changing position at a common position.

* * * * *